United States Patent [19]

Kato et al.

[11] Patent Number: 4,766,872

[45] Date of Patent: Aug. 30, 1988

[54] CANISTER FOR CAPTURING EVAPORATED FUEL

[75] Inventors: Takashi Kato; Kazumi Haruta, both of Obu; Yutaka Yamada, Hekinan, all of Japan

[73] Assignee: Aisan Kogyo Kabushiki Kaisha, Ohbu, Japan

[21] Appl. No.: 55,880

[22] Filed: Jun. 1, 1987

[30] Foreign Application Priority Data

Jun. 2, 1986 [JP] Japan ..... 61-128775

[51] Int. Cl.[4] ..... F02M 33/02

[52] U.S. Cl. ..... 123/519; 55/475

[58] Field of Search ..... 123/519, 520; 55/475

[56] References Cited

U.S. PATENT DOCUMENTS 3,884,204 5/1975 Krautwurst et al. ..... 123/519

4,496,379 1/1985 Kozawa ..... 123/519 X

FOREIGN PATENT DOCUMENTS 5717723 7/1955 Japan .

5717721 7/1955 Japan .

5719188 2/1982 Japan .

60-169662 9/1985 Japan ..... 123/519

*Primary Examiner*—Tony M. Argenbright

*Assistant Examiner*—Eric R. Carlberg

*Attorney, Agent, or Firm*—Cushman, Darby & Cushman

[57] ABSTRACT

The invention relates to a horizontally mounted canister having a evaporated fuel supply port and a purge port provided on one side of an absorber chamber therein, an atmospheric air port provided on the other side thereof, a movable tray pushing one side surface of the absorber, and an additional absorber chamber which projects upward at the top and which is provided in the absorber chamber.

4 Claims, 4 Drawing Sheets

CANISTER FOR CAPTURING EVAPORATED FUEL

BACKGROUND OF THE INVENTION

1. Field of the Invention:

The present invention relates to a canister for capturing evaporated fuel.

2. Description of the Prior Art:

It is well known for canisters 3 and 4 as shown in FIGS. 9 and 10, to be used in automobiles for the purpose of capturing fuel evaporated in the area in which a gaseous fuel is distributed and the fuel evaporated at the oil inlet gate 2 of a fuel tank 1, and for feeding the captured fuel to be fed to an engine during its operation so as to prevent the evaporated fuel from being discharged into the atmosphere, as well as preventing fuel loss, one of which is shown in U.S. Pat. No. 3,884,204.

There are two types of canister, one of which is a vertical posture such as that shown by reference numeral 3 in FIG. 9, and the other of which is horizontal as shown by reference numeral 4 in FIG. 9 and FIG. 10, the former, being disclosed, for example, in Japanese Utility Model Unexamined Publication No. 57-123953, and the latter, for example in Japanese Utility Model Unexamined Publication No. 57-19188.

Recently, evaporated fuel of higher pressure has been employed in some automobiles, and this has led to an increase in the quantity of evaporated fuel stored in fuel tanks. As a result of this, there has been a demand for the canister of larger size. In order to enlarge the capacity of the conventional vertically mounted canister and because of the space limitation within the engine compartments of modern automobiles which allow for no increase in the diameter of the canister, it is necessary to increase the overall height of the canister.

However, since there has been a trend to lower the overall height of engine compartments even further in recent years, the limitations on the overall height of canisters has prevented the vertically mounted type canister from being enlarged in capacity. In the case of a horizontally mounted canister, there is no such problem but in this case there is another difficulty as described below.

As shown in FIG. 11 and FIG. 12, a canister case 5 formed in a cylindrical shape extending from an evaporated fuel supply port 6 to an atmospheric air port 7 with a constant diameter has an absorber 8 sealed therein, one side of which is pressed by a movable mesh tray 9 urged by a spring 10. If for some reason, the movable mesh tray 9 gets caught, gaps will be formed in among particles of fuel absorber and then the absorber 8 will settle due to vibration of the canister. As a result of this, a space 11 will be formed above the entire surface of the absorber forming a free passage between the evaporated fuel supply port 6 and the atmospheric air port 7 through which supplied fuel can pass without being captured. Thus the capacity of the canister capturing evaporated fuel will deteriorate, resulting in discharge of evaporated fuel causing air pollution. In these drawings, reference numerals 12 and 13 show filters and reference numeral 14 shows a purge port.

SUMMARY OF THE INVENTION

An object of this invention is provide a horizontally mounted canister overcoming the problem mentioned above by ensuring that no space can be produced that would create a direct passage between an evaporated fuel supply port and an atmospheric air port, thereby securing the performance of the canister.

In order to overcome the problem mentioned above, there is provided a horizontally mounted canister having an evaporated fuel supply port and a purge port on one side of a chamber for storing an evaporated fuel absorber and the other side thereof an atmospheric air port, whereby an evaporated fuel flows in the horizontal direction, and a movable mesh tray that presses the absorber layer from one side thereof, characterized by the provision of an additional chamber projecting upwardly from the top of the main chamber for the absorber.

If a space is produced in the absorber as a result of vibration or the like in the normal operating condition in which the movable tray is capable of movement, the movable mesh tray presses against and pushes the absorber forward so that any space is filled up. In a case where the movable tray gets caught by something such as the side wall of the canister case, the dead weight of the absorber located above any formed gap will cause it to settle down and to occupy the space.

Ultimately, the additional absorber accomodated in the additional chamber therefor will settle down to the same degree as does the absorber in the main chamber so that the space formed is filled up. Even though a space is produced above the additional absorber in the additional chamber, no space directly connecting the evaporated fuel supply port with the atmospheric air port will be produced in any portion of the main chamber containing the absorber.

PREFERRED EMBODIMENTS OF THE INVENTION

Figure 1:
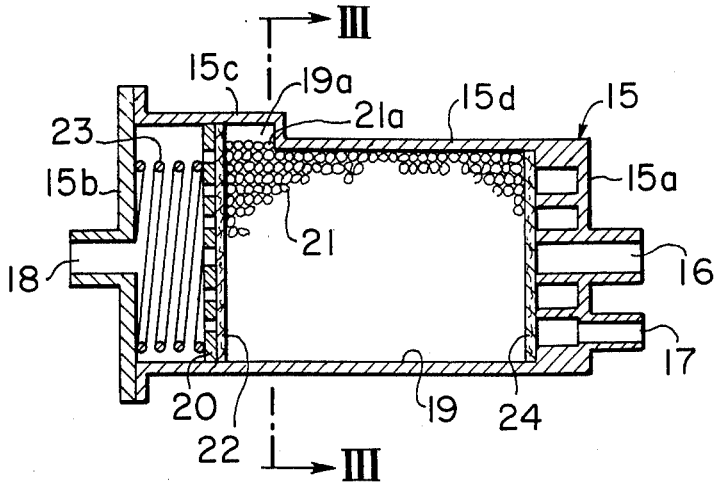
FIG. 1 is a side cross sectional view of a first embodiment of this invention.
Figure 2:
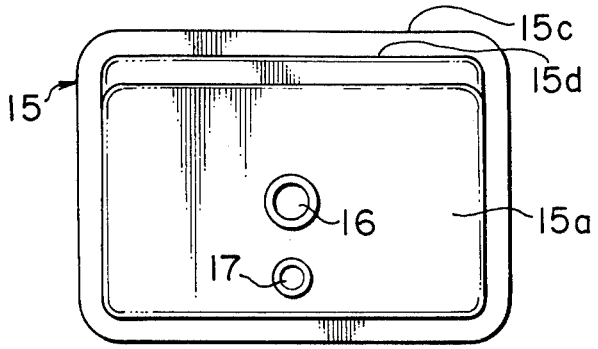
FIG. 2 is a front view of the first embodiment of this invention.
Figure 3:
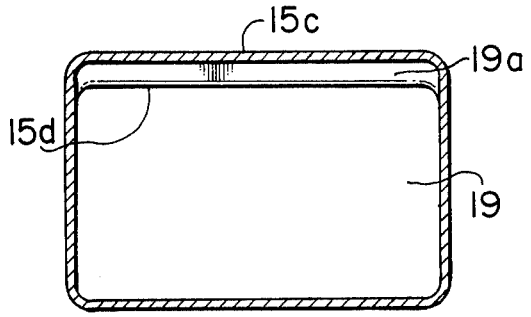
FIG. 3 is a cross sectional view taken on line III—III of FIG. 1.

A first embodiment is described below with reference to FIG. 1 and FIG. 3.

Figure 4:
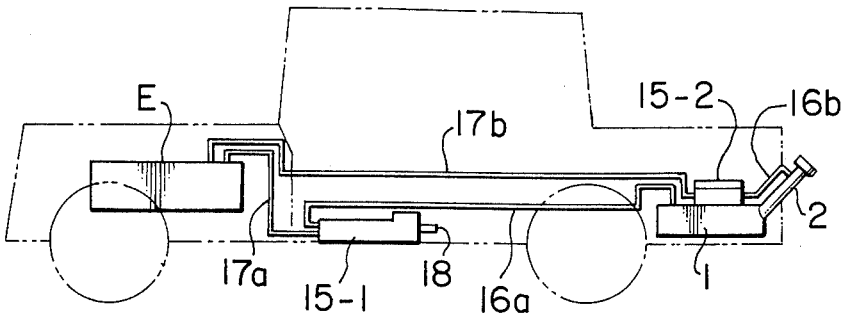
FIG. 4 is a view of a canister in the installed state.
Figure 5:
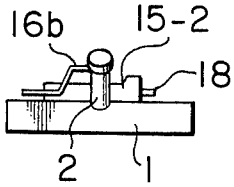
FIG. 5 is a side view of the canister installed on a fuel tank.

An evaporated fuel supply port 16 and a purge port 17 are provided on a front wall 15*a* of a flat canister case 15. An atmospheric air port 18 is provided on a rear wall 15*b*. These ports are opened in an absorber chamber 19 accommodated in the canister case 15. The canister case has a top wall 15*c* that is near the atmospheric air port 18 and higher than another top wall 15*d* for accommodating an additional absorber chamber 19*a*. Within the part of the additional absorber chamber 19*a*, a tray 20 is disposed longitudinally and movably in the absorber chamber 19, for holding one side surface of an absorber 21 charged in the absorber chamber 19 through the intermediary of a filter 22. A spring 23 is provided between the movable tray 20 and the rear wall 15*b* so as to urge the movable tray 20 and the filter 22 to hold the absorber 21. While the other side of the absorber 21 which is facing the evaporated fuel supply port 16 and the purge port 17 is held by a filter 24, the absorber chamber 19 and the additional chamber 19*a* are filled with the absorber when the canister is being assembled. The assembled canister is horizontally mounted on a car body or a fuel tank 1 as shown in FIG. 4. As a result of this provision, fuel evaporated in the gaseous fuel distribution portion of the fuel tank 1 is fed to the evaporated fuel supply port 16 of a first canister 15-1 by way of a passage 16*a*. Fuel evaporated at a oil inlet gate 2 of the fuel tank 1 is fed to the evaporated fuel supply port 16 of a second canister 15-2 by way of a passage 16*b*. Purge ports (shown by single reference numeral 17) of the first canister 15-1 and the second canister 15-2 are connected to the air inlet portion of engine E by way of the passages 17*a* and 17*b*.

Fuel that evaporates in the fuel tank or the like when an engine is stopped is introduced to the canister by way of the evaporated fuel supply port 16 and is captured by the absorber 21 during the course of its flow toward the atmospheric air port 18. When the engine is started, the fuel captured by the absorber 21 is introduced to the engine with the aid of a flow of air taken in at the atmospheric air port 18 and fed through the absorber 21 to the purge port 17 that is connected with the engine. The additional absorber chamber 19*a* is filled with the absorber 21 when the canister is being assembled. If gaps are produced in the absorber 21 as a result of vibration or the like, the movable tray 20 presses against and pushes the absorber 21 forward with the aid of the spring 23 so that any gap is filled up.

In a case where the movable tray 20 gets caught by something such as the walls of the canister 15, it is impossible for the absorber urged by the movable tray 20 to fill up the gaps. In order to fill the gaps produced, the dead weight of the absorber located above any formed gap will cause it to settle down and to occupy that gap. Ultimately, the absorber accommodated in the additional chamber 19*a* thereof will settle down to occupy the gaps. Although a space is produced above the additional absorber in the additional chamber 19*a*, no space above the other top wall 15*d* will be produced. As a result of the additional absorber settling in this way, all evaporated fuel will be captured by th absorber.

Figure 6:
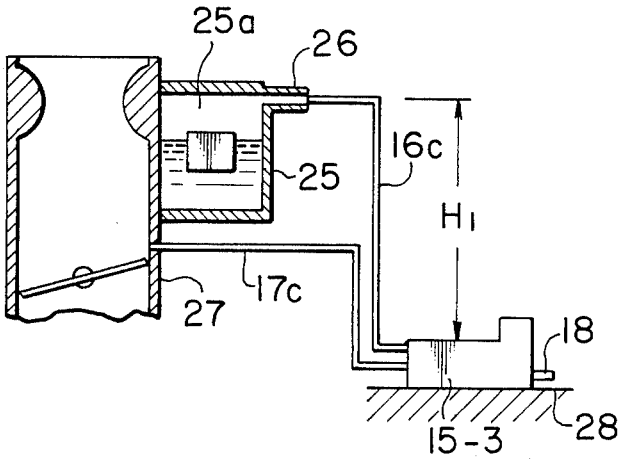
FIG. 6 is a view of the canister installed for the purpose of capturing fuel evaporated in a float chamber of a carburetor.
Figure 13:
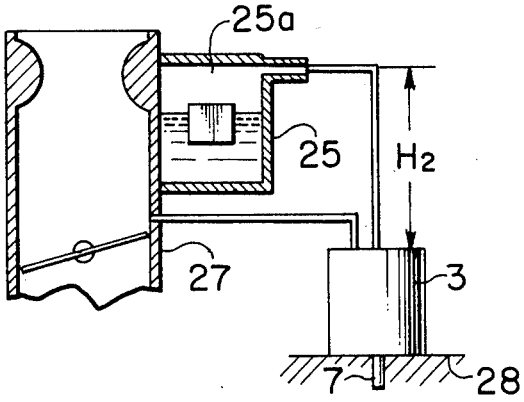
FIG. 13 is a view of a conventional vertically mounted canister for capturing fuel evaporated in a float chamber of a carburetor.

Advantage of the flat canister will be apparent from FIG. 6. In a case where the evaporated fuel supply port 16 of a flat canister 15-3 is connected with an outvent 26 of a float chamber 25 by a passage 16*c* and the purge port 17 thereof is connected with an air intake pipe 27 by a passage 17*c* for capturing fuel evaporated in a gaseous fuel distribution portion 25*a* of a float chamber 25, it is possible for any difference in height ($H_1$) between the top of the gaseous fuel distribution portion 25*a* of the float chamber 25 and the canister 15-3 to be increased. That is, the top of the horizontal canister 15-3 is lower than that of the vertical canister 3 shown in FIG. 13, when both of them are measured from a plane 28. As a result of this, the difference in height ($H_1$) of the horizontal, flat canister is larger than that of the vertical canister 3, and it is also larger than that of the conventional, cylindrical, horizontal canister 4. The resulting increase in difference in height ($H_1$) of the canister will raise the pressure that is generated to send the fuel evaporated at the float chamber 25, when the engine is stopped, toward the canister, and prevent the evaporated fuel from being fed to the intake pipe 27 through an inner vent. Ultimately, performance in restarting the engine is improved by the consequent prevention of enrichment of the air fuel ratio when the engine is restarted. In addition, this flat, horizontal canister meets the demand for lowering the height of the engine compartment, while having the same capacity as that of the vertical canister or the cylindrical, horizontal canister.

Figure 7:
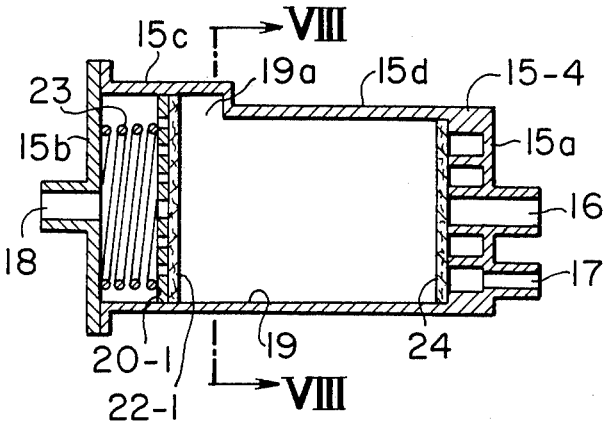
FIG. 7 is a side cross sectional view of a second embodiment of this invention.
Figure 8:
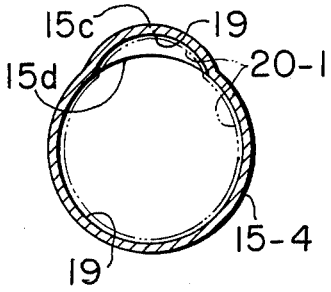
FIG. 8 is a cross sectional view taken on line VIII—VIII of FIG. 7.
Figure 9:
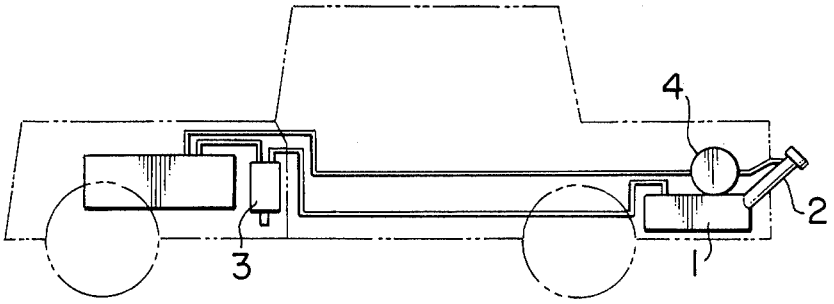
FIG. 9 is a view of a conventional canister in the installed state.
Figure 10:
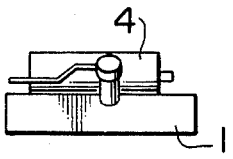
FIG. 10 is a side view of the conventional canister installed on a fuel tank.
Figure 11:
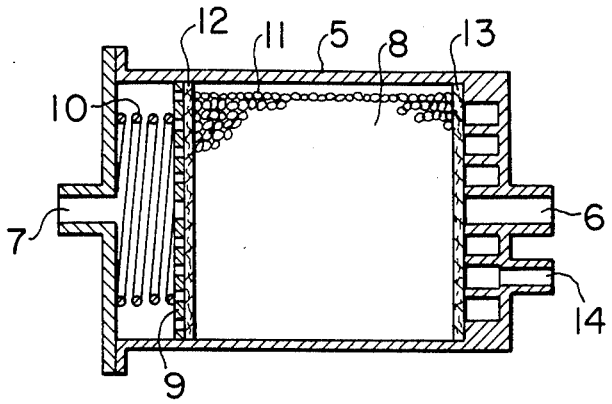
FIG. 11 is a side cross sectional view of a conventional horizontally mounted canister.
Figure 12:
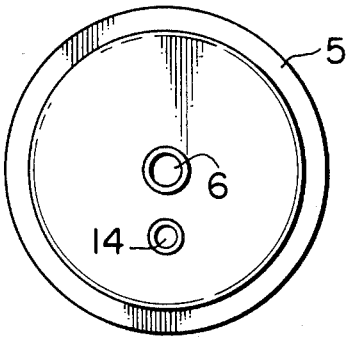
FIG. 12 is a front view of a conventional horizontally mounted canister.

A second embodiment of this invention is described below with reference to FIG. 7 and FIG. 8. A canister case 15-4 is formed in a cylindrical shape and has the additional absorber chamber 19*a* at the top rear portion thereof. A movable tray 20-1 and a filter 22-1 of this embodiment are aligned with the inner surface of the absorber chamber 19 and the additional chamber 19*a* as shown by the short dashed line in FIG. 8. The rest of the structure is same as that in the previous embodiment. As shown in the previous embodiment, the absorber accommodated in the additional absorber chamber 19*a* settles down so as to capture the evaporated fuel. It is permissible for the additional absorber chamber 19*a* located in the top portion above the atmospheric air port, as shown in the embodiments described above, to be replaced by one located in the top portion above the evaporated fuel supply port, etc.

According to this invention, if the movable tray of the horizontal canister is caught by something, it is possible for the space produced above the absorber to be prevented from providing a direct connection between the evaporated fuel supply port and the atmospheric air port. As a result of this, the ability of the canister to capture the evaporated fuel can be improved by the capture of all the evaporated fuel there, which will prevent air pollution by restricting the release of evaporated fuel.

What is claimed is:

1. A horizontally mounted canister for capturing evaporating fuel comprising:

a canister case having a horizontally disposed longitudinal axis, said canister case having a top wall and first and second end walls, one of said end walls having an evaporated fuel supply port defined therethrough and a purge port defined therethrough, the other of said end walls having an atmospheric air port defined therethrough, said top wall having a first portion defining a first height of said case and a second portion defining a second height of said case, greater than said first height, said first height defining with said first and second end walls a first absorber chamber for receiving an absorber, said second portion of said top wall defining a second absorber chamber vertically above the first absorber chamber for receiving additional absorber;

a tray slidably received within said canister case in the portion thereof defined by said second portion of said top wall, said tray being vertically disposed in said canister case in a plane disposed substantially transverse to said longitudinal axis of said canister case; and a spring disposed between one of said end walls and said tray for urging said tray toward the other of said end walls, so that said tray presses against an absorber within said first absorber chamber between said tray and said other end wall so as to prevent the formation of voids in absorber within said first absorber chamber, said tray also being urged against an absorber within said second absorber chamber whereby absorber in said second absorber chamber replenishes said first absorber chamber when voids are formed in said absorber in said first absorber chamber.

2. A canister as set forth in claim 1, wherein said second absorber chamber is defined adjacent the end wall having said evaporated fuel supply port defined therethrough.

3. A canister as set forth in claim 1, wherein said second absorber chamber is defined adjacent the end wall of said canister case having said atmospheric port defined therethrough.

4. A canister as set forth in claim 1, wherein said second absorber chamber is defined by a portion of said first absorber chamber which projects upwardly therefrom.

* * * * *